US008152064B2

(12) United States Patent
Svane et al.

(10) Patent No.: US 8,152,064 B2
(45) Date of Patent: Apr. 10, 2012

(54) SYSTEM AND METHOD FOR ADJUSTING A DIRECTION OF FIRE

(75) Inventors: Mark S. Svane, Tioga, TX (US); David W. Fore, Plano, TX (US); Kevin Underhill, McKinney, TX (US); Richard C. Vera, Allen, TX (US)

(73) Assignee: Raytheon Company, Waltham, MA (US)

( * ) Notice: Subject to any disclaimer, the term of this patent is extended or adjusted under 35 U.S.C. 154(b) by 730 days.

(21) Appl. No.: 12/271,008

(22) Filed: Nov. 14, 2008

(65) Prior Publication Data

US 2009/0123894 A1 May 14, 2009

Related U.S. Application Data

(60) Provisional application No. 60/987,979, filed on Nov. 14, 2007.

(51) Int. Cl.
*G06F 19/00* (2006.01)

(52) U.S. Cl. ..... 235/404; 356/141; 455/604

(58) Field of Classification Search ..... 235/404; 455/604, 607, 606; 356/141, 152; 89/41.05, 89/41.17, 41.19, 41.06; 244/3.11, 3.16
See application file for complete search history.

(56) References Cited

U.S. PATENT DOCUMENTS

| | | | | |
|---|---|---|---|---|
| 3,962,537 | A | 6/1976 | Kearns et al. | 178/6.8 |
| 4,267,562 | A | 5/1981 | Raimondi | 358/109 |
| 5,114,227 | A | 5/1992 | Cleveland, Jr. | 356/152 |
| 6,038,955 | A | 3/2000 | Thiesen et al. | 89/41.17 |

OTHER PUBLICATIONS

PCT Notification of Transmittal of the International Search Report and the Written Opinion of the International Searching Authority, or the Declaration with attached PCT International Search Report and Written Opinion of the International Searching Authority in International Application No. PCT/US2008/083499, dated Mar. 20, 2009, 12 pages.

"*Local Area ESS, Basic Concepts and Approach*", Raytheon, PowerPoint Presentation, 14 pages, May 30, 2000.

Charles J. Pruszynski, et al, "*Tactical Far Target Location Using Position and Azimuth From A P(Y) Code GPS Attitude Determination System*", 9 pages, 2001.

*Primary Examiner* — Karl D. Frech
(74) *Attorney, Agent, or Firm* — Schwegman, Lundberg & Woessner, P.A.; Gregory J. Gorrie

(57) ABSTRACT

A method for adjusting a direction of fire includes moving a view of at least one sensor between a target area and an impact area, where a sensor performs target location. Sensor data is received from the sensor. The sensor data includes target area sensor data generated in response to sensing the target area and impact area sensor data generated in response to sensing the impact area. Image processing is performed on the sensor data to determine at least one angle between a first line from the sensor to the target area and a second line from the sensor to the impact area. Further, a set of refinements to coordinates corresponding to the target area is determined according to the at least one angle and an impact distance between the at least one sensor and the impact area. The set of refinements is communicated in order to facilitate firing upon the target area.

17 Claims, 3 Drawing Sheets

SYSTEM AND METHOD FOR ADJUSTING A DIRECTION OF FIRE

RELATED APPLICATION

This application claims benefit under 35 U.S.C. §119(e) of U.S. Provisional Application Ser. No. 60/987,979, entitled "System and Method for Adjusting Fire," filed Nov. 14, 2007, by Mark S. Svane et al.

TECHNICAL FIELD OF THE INVENTION

This invention relates generally to the field of targeting and more particularly to a system and method for adjusting a direction of fire.

BACKGROUND OF THE INVENTION

Known techniques for long range targeting and firing missions may involve inefficiencies and inaccuracies. In some known techniques, after a target is fired upon, a user estimates the distance between the area of impact and the intended target. The user then determines adjusted coordinates based on the estimate. Finally, the user gives the adjusted coordinates over a voice radio. These techniques, however, take precious time. In addition, the user is typically not the sensor operator, who has the best look at the target.

In other known techniques, Far Target Location (FTL) devices use global positioning system interferometer subsystems (GPSISs) to calculate the location of a target. The GPSISs, however, may have a cross axis GPS drift that may yield significant error. This error contributes to the high Circular Error Probability (CEP) calculations seen with these techniques. The error may drift with time, so GPS locations calculated one to two minutes apart may be dramatically different.

SUMMARY OF THE INVENTION

A method for adjusting a direction of fire includes moving a view of at least one sensor between a target area and an impact area, where a sensor performs target location. Sensor data is received from the sensor. The sensor data includes target area sensor data generated in response to sensing the target area and impact area sensor data generated in response to sensing the impact area. Image processing is performed on the sensor data to determine at least one angle between a first line from the sensor to the target area and a second line from the sensor to the impact area. Further, a set of refinements to coordinates corresponding to the target area is determined according to the at least one angle and an impact distance between the at least one sensor and the impact area. The set of refinements is communicated in order to facilitate firing upon the target area.

The method may include performing Scene Based Electronic Scene Stabilization upon the sensor data. The at least one sensor may be a Long Range Advanced Scout Surveillance System or it may be an Improved Target Acquisition System. The at least one angle may be determined by measuring scene movement while moving the view of the at least one sensor between the target area and the impact area.

An apparatus for use in adjusting a direction of fire includes a memory medium, at least one sensor, a processor, and an interface. The memory medium stores image processing code. The sensor is operable to perform target location and generate sensor data. The sensor data includes target area sensor data generated in response to sensing a target area. The sensor data also includes impact area sensor data generated in response to sensing an impact area. The processor is operable to execute the image processing code on the sensor data to determine at least one angle between a first line from the at least one sensor to the target area and a second line from the at least one sensor to the impact area. The processor is further operable to determine a set of refinements to coordinates corresponding to the target area according to the at least one angle and an impact distance between the at least one sensor and the impact area. The interface is operable to communicate the set of refinements in order to facilitate firing upon the target area.

Depending on the specific features implemented, particular embodiments may exhibit some, none, or all of the following technical advantages. Coordinates for a target may be generated without the error introduced by cross axis GPS drift. In addition, coordinates for an adjusted direction of fire may be communicated rapidly. Other technical advantages will be readily apparent to one skilled in the art from the following figures, description and claims.

DETAILED DESCRIPTION OF THE INVENTION

Figure 1:
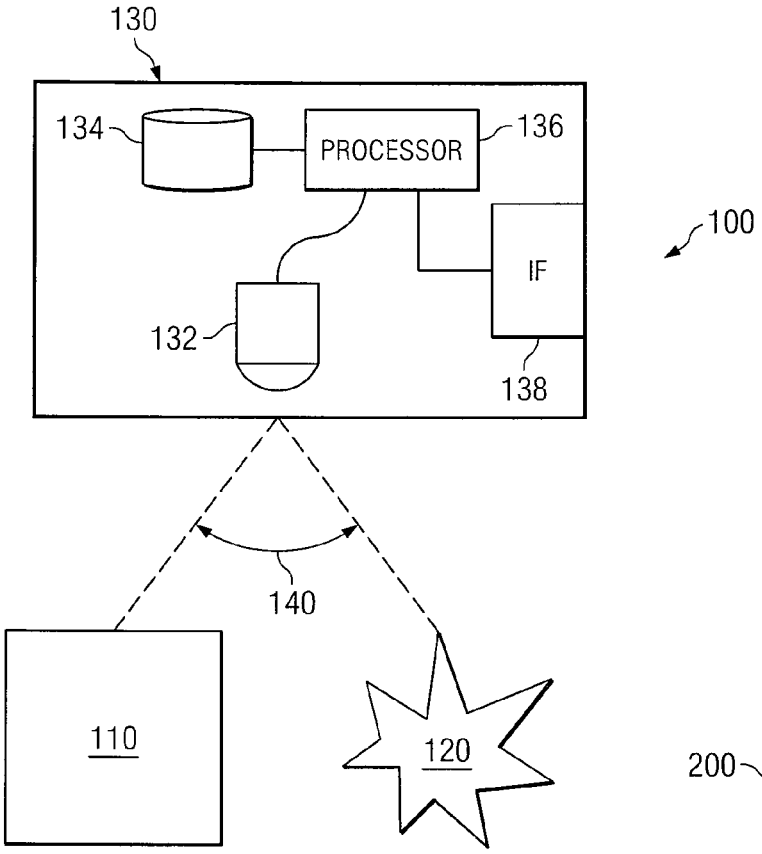
FIG. 1 illustrates one embodiment of a system for adjusting a direction of fire.

FIG. 1 illustrates one embodiment of a system 100 for adjusting a direction of fire. Targeting device 130 may be utilized to determine coordinates of target area 110 by employing targeting equipment 132, memory medium 134, and processor 136. These coordinates may be communicated utilizing interface (IF) 138. After a weapon fires a projectile at target area 110, targeting device 130 may examine impact area 120, the location where the projectile landed. If impact area 120 and target area 110 do not overlap (e.g., if the projectile did not strike target area 110), targeting device 130 may generate a set of refinements for the coordinates of target area 110. The refinements may be generated by, in part, measuring angle 140, which is at least one angle between target area 110 and impact area 120 from the perspective of targeting device 130. Angle 140 may include azimuth as well as elevation angles between target area 110 and impact area 120 from the perspective of targeting device 130. The refinements may be communicated using interface 138 to adjust the direction of fire. Further details of this and other embodiments are described below with respect to FIG. 2.

Targeting equipment 132 may include one or more sensors capable of Far Target Location (FTL). Examples of such sensors may include Long Range Advanced Scout Surveillance System (LRAS3) or Improved Target Acquisition System (ITAS) sensors equipped with GPS Interferometer Subsystems (GPSIS). Examples may also include laser-based distance sensors and optical sensors.

Processor 136 may be a microprocessor, controller, or any other suitable computing device, resource, or combination of hardware, software, and/or encoded logic operable to provide, either alone or in conjunction with other targeting device 130 components (e.g., memory medium 134 and/or interface 138), adjusting direction of fire functionality. Such functionality may include providing various features discussed herein to a user.

One feature that certain embodiments may provide may include determining a set of refinements to coordinates associated with a target such as an enemy target. These refinements may be determined in part by the position/coordinates of a missed shot fired at the target. In certain embodiments, processor 136 may be able to count the number of pixels between target area 110 and impact area 120. Based on the number of pixels, the coordinates of target area 110, and the range to impact area 120, processor 136 may be able to adjust incorrect coordinates of the enemy target so that the next shot is more likely to hit the enemy target. The pixels may be processed using an imaging algorithm, such as Scene Based Electronic Scene Stabilization (SBESS).

Memory 134 may be any form of volatile or non-volatile memory including, without limitation, magnetic media, optical media, random access memory (RAM), read-only memory (ROM), removable media, or any other suitable tangible computer readable medium. Memory 134 may store any suitable data or information, including software and encoded logic, utilized by targeting device 130 in determining how to adjust the coordinates associated with an enemy target for the next shot. For example, memory 134 may maintain a listing, table, or other organization of information reflecting the position/coordinates of an enemy target. The information may be used to determine an adjustment of the coordinates of the enemy target. Memory 134 may also store any logic needed to perform any of the functionality described herein. For example, memory 134 may store one or more algorithms that may be used to determine the azimuth and/or elevation angles from the number of pixels between target area 110 and impact area 120.

Interface 138 may comprise any suitable interface for a human user such as a touch screen, a microphone, a keyboard, a mouse, or any other appropriate equipment according to particular configurations and arrangements. It may also include at least one display device, such as a monitor. It may further comprise any hardware, software, and/or encoded logic needed to be able to send and receive information to other components. For example, interface 138 may transmit messages updating and/or adjusting the location of a particular enemy target. In particular embodiments, interface 138 may be able to send and receive Join Variable Message Format messages over a Tactical Network for Army use.

Figure 2:
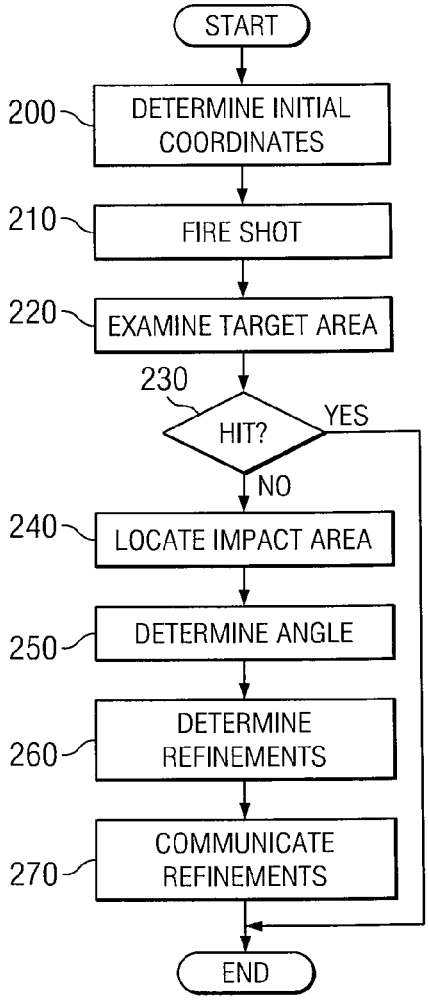
FIG. 2 is a flowchart depicting one embodiment of the operation of the system of FIG. 1.

FIG. 2 illustrates one embodiment of the operation of targeting device 130. In general, the steps illustrated in FIG. 2 may be combined, modified, or deleted where appropriate, and additional steps may also be added to the example operation. Furthermore, the described steps may be performed in any suitable order.

The method starts at step 200, where targeting device 130 determines initial coordinates for target area 110. In some embodiments, targeting equipment 132 may use sensors, such as, laser targeting sensors, optics, and GPS information to determine the coordinates. Example systems utilizing this technology include Long Range Advanced Scout Surveillance System (LRAS3) and Improved Target Acquisition System (ITAS), which may be equipped with GPS Interferometer Subsystems (GPSIS). After the initial coordinates are determined and communicated, a shot may be fired at target area 110 at step 210.

At step 220, in some embodiments, targeting device 130 examines target area 110. The fired shot may have hit target area 110. At step 230, if target area 110 was hit, the method ends. If target area 110 was not hit, the method moves to step 240. At step 240, targeting device 130 may be used to locate impact area 120. In some embodiments, this may occur before step 220. Steps 220 and 240 may be accomplished by moving the view of optical sensors and/or other sensors present in targeting equipment 132 between target area 110 and impact area 120. If target area 110 is to be fired upon again, targeting device 130 may produce a set of refinements to the initial coordinates for target area 110, as described further below.

At step 250, in some embodiments, targeting device 130 may determine angle 140. In certain embodiments, the angle may be determined by moving the view of targeting device 130 between target area 110 and impact area 120. This may occur, for example, while either target area 110 is located (as in step 220) or impact area 120 is located (as in step 240). In certain cases, processor 136 of targeting device 130 may apply image processing algorithms (such as SBESS) stored in memory medium 134 to the output of the sensors to determine angle 140. In some embodiments, determining angle 140 may include performing a frame-by-frame comparison of the output of targeting equipment 132 and measuring the scene movement as the view of targeting device 130 is moved. Features of the images captured by targeting device 130 may be analyzed (such as edges of objects) while the view of targeting device 130 is moved. Processor 136 may be utilized to perform calculations based this analysis to determine an angle 140. Determining angle 140 may include determining an azimuth angle and an elevation angle.

At step 260, in some embodiments, a set of refinements to the coordinates corresponding to target area 110 may be determined based upon angle 140. Targeting device 130 may use sensors in targeting equipment 132 (such as laser-based distance sensors) to determine the impact distance between targeting device 130 and impact area 120. Processor 136 may be utilized to execute calculations based upon angle 140, the impact distance, and the coordinates of target area 110 to generate a set of refinements to the coordinates corresponding to target area 110. For example, targeting device 130 may use trigonometric calculations based on angle 140, coordinates corresponding to target area 110, and the impact distance to determine the set of refinements. In certain embodiments, coordinates of impact area 120 may also be utilized (along with angle 140 and the impact distance) to determine the set of refinements to coordinates corresponding to target area 110. At step 270, the determined refinements to the coordinates corresponding to target area 110 may be communicated using interface 138. This communication may be executed in order to support a second fire directed towards target area 110.

Particular embodiments may include a point-and-click option to imitate the direction adjustment. The sensor may automatically provide a drop-down menu that includes a "Adjust for Fires" option on the sensor sight. The sensor may then automatically calculate the change in distance and correct the direction of fire.

Figure 3:
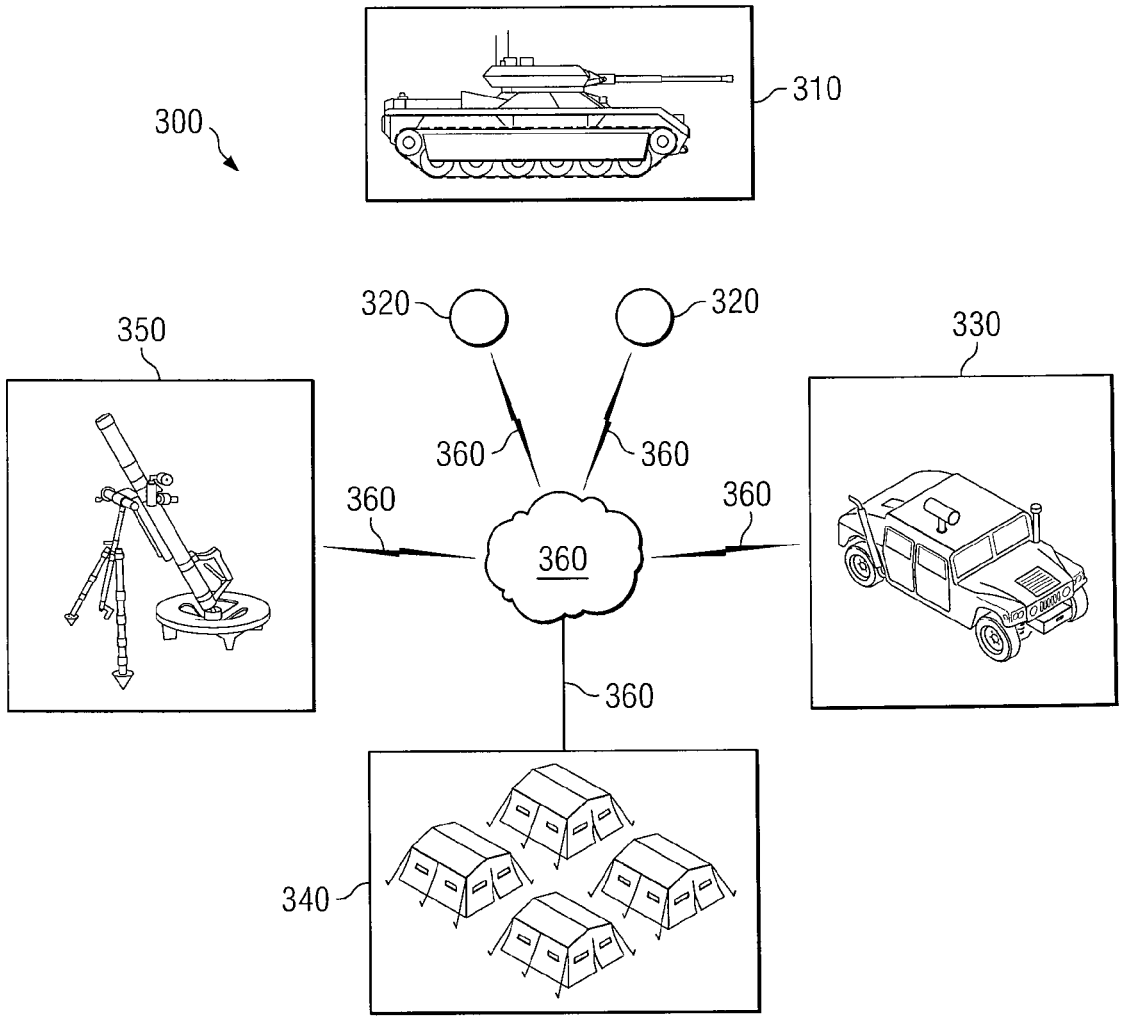
FIG. 3 illustrates one embodiment of a system for adjusting a direction of fire utilizing a network.

FIG. 3 illustrates one embodiment of a system 300 for adjusting a direction of fire. Target area 310 may be observed by reconnaissance agents 320. Reconnaissance agents 320 may transmit these observations utilizing network connections 360 to field unit 330. Field unit 330 may utilize one or more sensors to gather more information on target 310 and transmit a Call for Fire utilizing network connections 360. Tactical operations center 340 may evaluate the Call for Fire and request that rounds be fired at target 310 utilizing network connections 360. Weapon 350 may fire upon target 310 in response to receiving the request for rounds to be fired from network connections 360. Field unit 330 may observe the round(s) fired by weapon 350 and communicate refinements to coordinates utilizing network connections 360 in case the fired round(s) missed target 310.

Reconnaissance agents 320, in some embodiments, may be field troops gathering data on foot. They may also be sensors, such as imaging devices, deployed to capture and transmit data without user interaction. In various embodiments, they may be drones.

Network connections 360 may be a communication platform operable to exchange data or information, such as a packet data network that has a communications interface or exchange. Other examples of network connections 360 include any local area network (LAN), metropolitan area network (MAN), wide area network (WAN), wireless local area network (WLAN), virtual private network (VPN), intranet, or any other appropriate architecture or system that facilitates communications. In various embodiments, network connections 360 may include, but are not limited to, wired and/or wireless mediums which may be provisioned with routers and firewalls. Network connections 360 may also include an Advanced Field Artillery Tactical Data System (AFATDS). Network connections 360 may communicate using the Joint Variable Message Format (JVMF) protocol.

Field unit 330 may include multiple sensors as in targeting equipment 132. It may also include personnel for making tactical decisions, such as whether or not to issue a Call for Fire. Field unit 330 may be provided with targeting equipment communication interfaces, such as targeting device 130.

Figure 4:
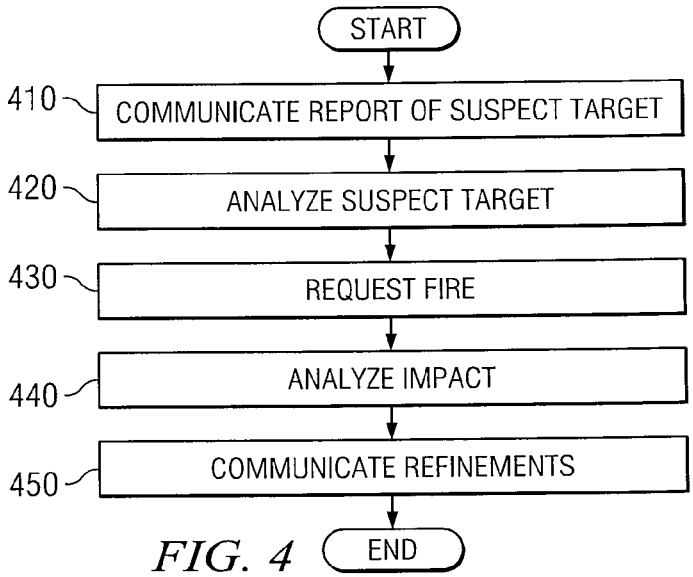
FIG. 4 is a flowchart illustrating one embodiment of the operation of the system of FIG. 3.

FIG. 4 is a flowchart illustrating one embodiment of the operation of system 300. In general, the steps illustrated in FIG. 4 may be combined, modified, or deleted where appropriate, and additional steps may also be added to the example operation. Furthermore, the described steps may be performed in any suitable order.

At step 410, in some embodiments, a report of a suspect target may be communicated on a network. This report may be generated by entities such as reconnaissance agents 320 described above. In some situations, this report about the suspect target might not contain enough information to proceed.

At step 420, in some embodiments, the suspect target may be analyzed for more information by an entity such as field unit 330. One or more sensors may be utilized to gather more information about the suspect target. This information may be analyzed by, for example, a small unit commander.

At step 430, in some embodiments, the small unit commander may request fire upon the suspect target using, for example, a Call For Fire command. Along with the request for fire, information about the suspect target may be transmitted on the network to a tactical operations center (such as tactical operations center 340), where the request for fire may be approved. The tactical operations center may send a message to a weapon utilizing the network indicating that the suspect target should be fired upon. A message may also be transmitted to the small field unit indicating the length of time before the fired projectile is expected to impact the suspect target. Further, messages may be communicated to the small field unit indicating that a shot has actually been fired as well as when the fired round is about to strike. These messages may be communicated utilizing a network such as network connections 360.

At step 440, in some embodiments, the impact of the fired round(s) may be analyzed utilizing an entity such as field unit 330. It may be determined that the fired round did not hit the intended target. In this situation, a set of refinements to the coordinates may be determined using field unit 330. This may be accomplished utilizing the devices and steps described above with respect to FIGS. 1 and 2.

At step 450, the set of refinements to the coordinates may be communicated to the weapons using the network. In some embodiments, the coordinates may be sent directly from the device that determined the refinements as opposed to being spoken over the network by personnel. Thus, an Adjust Fires operation may be accomplished by sending the refinements digitally. This may reduce the chances of error when communicating the coordinates and may be faster. Further, the capability to generate Adjust Fire messages may enable a sensor operator to rapidly engage a threat with non-line of sight (NLOS) fires while maintaining "eyes on target" and providing real time information.

Figure 5:
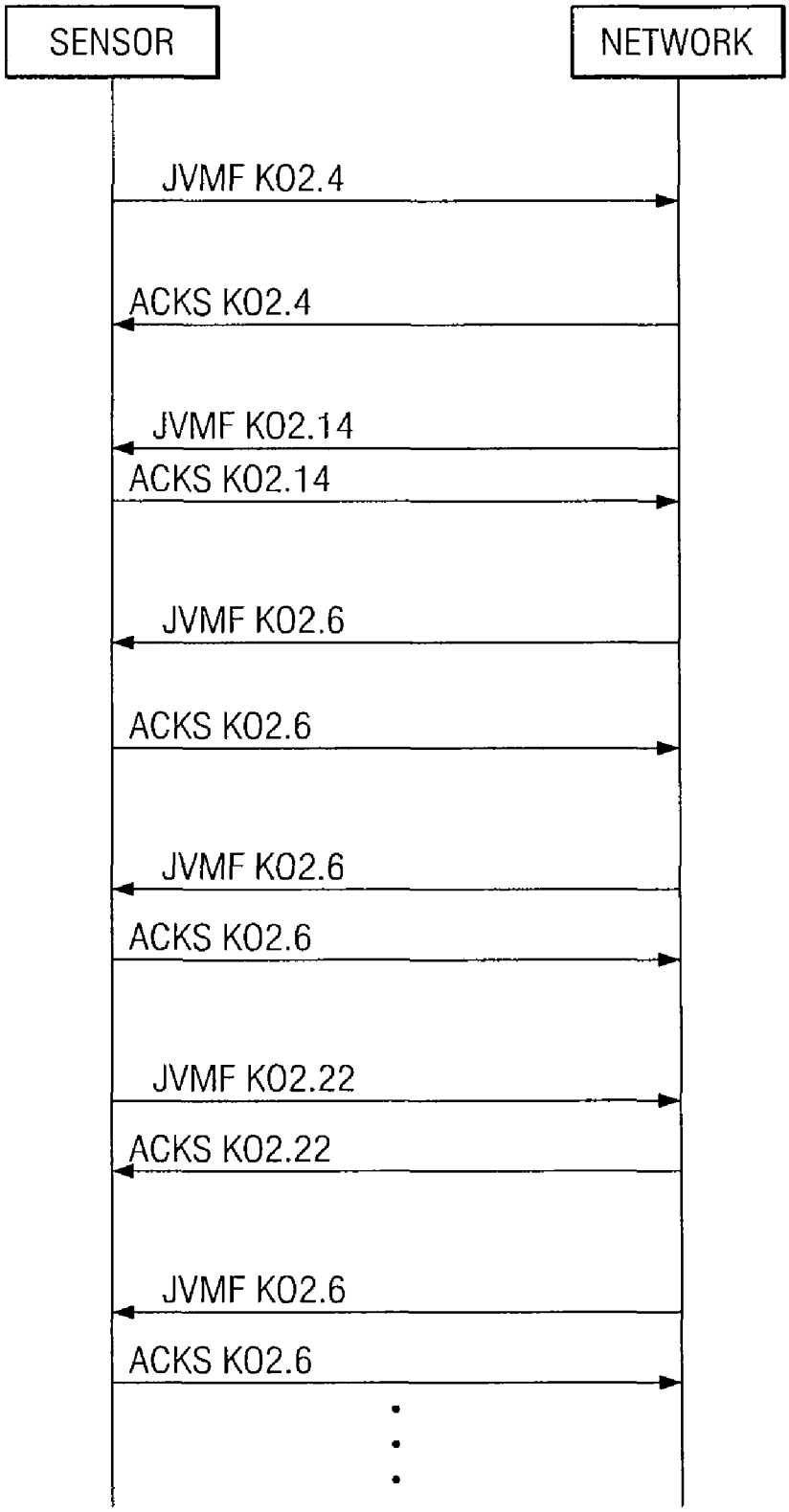
FIG. 5 is a network traffic diagram illustrating one embodiment of the network traffic generated by the operation depicted in FIG. 4.

FIG. 5 illustrates network traffic of an example embodiment of the system for adjusting a direction of fire as described above with respect to FIGS. 3 and 4. The Joint Variable Message Format (JVMF) protocol is employed. TABLE 1 gives examples of commands utilized in FIG. 5.

TABLE 1

| Message | Description | From | To | Type | Rate | Notes | Size bytes | Ack'd |
|---|---|---|---|---|---|---|---|---|
| K01.1 | Free Text Message | C2L/ AFATDS | Any/All Sensors | Unicast/ Multicast | async | Size base on 50 characters min and 400 chars max | 65-372 | yes/ no |
| K02.1 | Check Fire | LRAS3/ ITAS | AFATDS | Unicast | async | | 26 | yes |
| K02.14 | Message to Observer | AFATDS | LRAS/ C2L | Unicast | async | Time of flight | 26 | yes |
| K02.16 | End of Mission | LRAS3/ ITAS/ C2L | AFATDS | Unicast | async | | 32 | yes |
| K02.22 | Adjust Fire | LRAS3/ ITAS | AFATDS | Unicast | async | | 37 | yes |
| K02.37 | Observer Readiness Report | LRAS3/ ITAS | AFATDS | Unicast | async | Sent at same time as K05.1 | 38 | yes |
| K02.4 | Call for Fire | LRAS3/ ITAS/ C2L | AFATDS | Unicast | async | CFF short form | 49 | yes |
| K02.6 | Observer Mission Update | AFATDS | LRAS/ C2L | Unicast | async | Shot/Splash/ Rounds Cmp | 25 | yes |

TABLE 1-continued

| Message | Description | From | To | Type | Rate | Notes | Size bytes | Ack'd |
|---|---|---|---|---|---|---|---|---|
| K05.1 | Friendly Position Report | Any GPS Sensor | C2L/ FBCB2 | Multicast | Configurable with AMP | All GPS equipped sensors (including C2L). | 38 | no |
| K05.19 | Entity Report | LRAS3/ ITAS | C2L/ FBCB2 | Multicast | async | Target position and posture | 61 | no |
| BA | Slew to Cue Request | C2L | LRAS/ ITAS | Unicast | async | Binary Attachment. | 54 | no |
| BA | Image Request | C2L | LRAS/ ITAS | Unicast | async | Binary Attachment. | 46 | no |
| BA | Image Clip | LRAS3/ ITAS | C2L | Unicast/ Multicast | async | Binary Attachment. | 21556-65536 | no |
| H.264 | MPEG stream | LRAS3 | C2L | Multicast | Continuous | UDP | N/A | N/A |

Numerous other changes, substitutions, variations, alterations and modifications may be ascertained by those skilled in the art and it is intended that particular embodiments encompass all such changes, substitutions, variations, alterations and modifications as falling within the spirit and scope of the appended claims.

What is claimed is:

1. A method for adjusting a direction of fire, comprising:

moving a view of at least one sensor between a target area and an impact area, the at least one sensor performing target location;

receiving sensor data from the at least one sensor, the sensor data comprising target area sensor data generated in response to sensing the target area and impact area sensor data generated in response to sensing the impact area;

performing image processing on the sensor data to determine at least one angle between a first line from the at least one sensor to the target area and a second line from the at least one sensor to the impact area;

determining a set of refinements to coordinates corresponding to the target area according to the at least one angle and an impact distance between the at least one sensor and the impact area;

communicating the set of refinements in order to facilitate firing upon the target area; and wherein performing image processing on the sensor data to determine the at least one angle between the target area and the impact area further comprises:

determining the at least one angle by measuring scene movement while moving the view of the at least one sensor between the target area and the impact area.

2. The method of claim 1, the performing image processing on the sensor data comprising:

performing Scene Based Electronic Scene Stabilization.

3. The method of claim 1, wherein the at least one sensor is selected from the group consisting of:

a Long Range Advanced Scout Surveillance System (LRAS3); and an Improved Target Acquisition System (ITAS).

4. The method of claim 1, the communicating the set of refinements further comprising:

communicating the set of refinements to a tactical network coupled to a weapon.

5. The method of claim 1, further comprising:

utilizing a laser to determine the impact distance.

6. An apparatus for use in adjusting a direction of fire, comprising:

a memory medium comprising image processing code;

at least one sensor operable to:

perform target location; and generate sensor data comprising:

target area sensor data generated in response to sensing a target area; and impact area sensor data generated in response to sensing an impact area;

a processor operable to:

execute the image processing code on the sensor data to determine at least one angle between a first line from the at least one sensor to the target area and a second line from the at least one sensor to the impact area; and determine a set of refinements to coordinates corresponding to the target area according to the at least one angle and an impact distance between the at least one sensor and the impact area; and an interface operable to communicate the set of refinements in order to facilitate firing upon the target area; and wherein the processor is further operable to:

determine the at least one angle by measuring scene movement while moving a view of the at least one sensor between the target area and the impact area.

7. The apparatus of claim 6, the image processing code comprising Scene Based Electronic Scene Stabilization.

8. The apparatus of claim 6, wherein the at least one sensor is selected from the group consisting of:

a Long Range Advanced Scout Surveillance System (LRAS3); and an Improved Target Acquisition System (ITAS).

9. The apparatus of claim 6, the interface further operable to:

communicate the set of refinements to a tactical network coupled to a weapon.

10. The apparatus of claim 6, further comprising:

a laser utilized to determine the impact distance.

11. A method of adjusting a direction of fire, comprising:

receiving information regarding a suspect target from a network;

communicating a call for fire upon the suspect target utilizing a first network message;

receiving a second network message comprising a time to impact of at least one fire;

receiving sensor data from at least one sensor, the sensor data comprising suspect target sensor data generated in response to sensing the suspect target and impact area sensor data generated in response to sensing the impact area;

performing image processing on the sensor data to determine at least one angle between a first line from the at least one sensor to the suspect target and a second line from the at least one sensor to the impact area;

determining a set of refinements to coordinates corresponding to the suspect target according to the at least one angle and an impact distance between the at least one sensor and the impact area;

communicating the set of refinements utilizing a third network message; and wherein performing image processing on the sensor data to determine the at least one angle between the target area and the impact area further comprises:

determining the at least one angle by measuring scene movement while moving a view of the at least one sensor between the target area and the impact area.

12. The method of claim 11, the communicating the call for fire further comprising:

communicating the call for fire to a tactical operations center.

13. The method of claim 11, wherein the network comprises an Advanced Field Artillery Tactical Data System.

14. The method of claim 11, wherein the first, second, and third network messages utilize the Joint Variable Messages Format (JVMF) protocol.

15. The method of claim 11, the performing image processing on the sensor data further comprising:

performing Scene Based Electronic Scene Stabilization.

16. The method of claim 11, wherein the at least one sensor is selected from the group consisting of:

a Long Range Advanced Scout Surveillance System (LRAS3); and an Improved Target Acquisition System (ITAS).

17. The method of claim 11, further comprising:

utilizing a laser to determine the impact distance.

* * * * *